US005831510A

United States Patent [19]

Zhang et al.

[11] Patent Number: 5,831,510

[45] Date of Patent: Nov. 3, 1998

[54] PTC ELECTRICAL DEVICES FOR INSTALLATION ON PRINTED CIRCUIT BOARDS

[76] Inventors: Michael Zhang, 34315 Eucalyptus Ter., Fremont, Calif. 94555; Shou-Mean Fang, 135-12B Yamate-cho, Naka-ku, Yokohama 231, Japan

[21] Appl. No.: 710,925

[22] Filed: Sep. 24, 1996

Related U.S. Application Data

[63] Continuation of Ser. No. 242,916, May 16, 1994, abandoned.

[51] Int. Cl.[6] ..... H01C 7/10

[52] U.S. Cl. ..... 338/22 R; 338/203; 338/212; 338/324

[58] Field of Search ..... 338/22 R, 21, 338/22 SD, 203, 204, 20, 331, 312, 324, 328; 29/610.1, 620, 612

[56] References Cited

U.S. PATENT DOCUMENTS

| | | | |
|---|---|---|---|
| 3,775,725 | 11/1973 | Endo | 338/262 |
| 4,486,737 | 12/1984 | Ott | 338/22 R |
| 4,486,738 | 12/1984 | Sadlo et al. | 338/320 |
| 4,689,475 | 8/1987 | Kleiner et al. | 219/553 |
| 4,777,718 | 10/1988 | Henderson et al. | 29/620 |
| 4,924,074 | 5/1990 | Fang et al. | 219/548 |
| 4,977,309 | 12/1990 | Uchida | 219/541 |
| 5,216,404 | 6/1993 | Nagai et al. | 338/22 SD |
| 5,347,258 | 9/1994 | Howard et al. | 338/333 |

FOREIGN PATENT DOCUMENTS

| | | | |
|---|---|---|---|
| 0223404 | 5/1987 | European Pat. Off. | H01B 5/16 |
| 8716103 | 3/1988 | Germany | G01K 7/16 |
| WO 94/01876 | 1/1994 | WIPO | H01C 1/14 |
| WO 95/08176 | 3/1995 | WIPO | H01C 1/14 |

OTHER PUBLICATIONS

International Search Report for Application No. PCT/US95/05567, mailed Jul. 14, 1995.

"PolySwitch PTC Devices, Standard Product List", Raychem Corporation, May 1992.

"PolySwitch SMD Surface mount devices PTC overcurrent protection" trade brochure, Raychem Corporation, Nov. 1992.

"PolySwitch SMD Installation Guidelines" trade brochure, Raychem Corporation, Nov. 1992.

*Primary Examiner*—Renee S. Luebke
*Assistant Examiner*—Karl Easthom
*Attorney, Agent, or Firm*—Timothy H. P. Richardson; Marguerite E. Gerstner; Herbert G. Burkard

[57] ABSTRACT

Laminar electrical devices, in particular circuit protection devices, contain two laminar electrodes, with a PTC element between them, and a cross-conductor which passes through the thickness of the device and contacts one only of the two electrodes. This permits connection to both electrodes from the same side of the device. The device also includes layers of solder on the areas of the device through which connection is made, and separation and/or masking members which (a) reduce the danger of short circuits formed by solder flow during installation of the device and/or (b) provide a site for permanent marking of the device.

13 Claims, 3 Drawing Sheets

PTC ELECTRICAL DEVICES FOR INSTALLATION ON PRINTED CIRCUIT BOARDS

CROSS REFERENCE TO RELATED APPLICATIONS

This application is a continuation of U.S. application Ser. No. 08/242,916, filed May 16, 1994 now abandoned, and is related to, commonly assigned U.S. application Ser. No. 08/121,717, filed Sep. 15, 1993, by Siden, Thompson, Zhang and Fang (Docket No. MP1490-US1), now abandoned, and to, commonly assigned U.S. application Ser. No. 07/910,950, filed Jul. 9, 1992, by Graves, Zhang, Chandler, Chan and Fang, now abandoned, and the corresponding PCT application US93/06480, filed Jul. 8, 1993 (Docket No. MP1454). The entire disclosure of each of those US and PCT applications is incorporated herein by reference for all purposes.

BACKGROUND OF THE INVENTION

1. Field of the Invention

This invention relates to electrical devices.

2. Introduction to the Invention

Application Ser. No. 08/121,717 discloses a variety of improved devices (and methods of making such devices) which comprise a laminar electrical element, preferably a PTC resistive element composed of a conductive polymer, sandwiched between two laminar electrodes. These improved devices include a transverse conductive member (often referred to as a cross-conductor) which passes through the electrical element and is connected to one of the electrodes but not to the other. Preferably the device comprises a first laminar electrode which is connected to the cross-conductor; a second laminar electrode which is not connected to the cross-conductor; and an additional laminar conductive member which is (i) connected to the cross-conductor, (ii) secured to the same face of the electrical element as the second electrode, and (iii) spaced apart from the second electrode. The additional conductive member and the second electrode are preferably formed by removing a strip from a laminar conductive member, thus dividing the laminar conductive member into two parts.

These improved devices are particularly useful for installation, e.g. onto a printed circuit board, by soldered connections to the second electrode and the additional conductive member. For such installation, the additional conductive member and/or the second electrode are preferably provided with an outer layer of solder. As disclosed in Ser. No. 08/121,737, when the devices are made by dividing up an appropriately treated laminate comprising many devices, the preferred methods of preparation result in the surface of the first electrode also carrying an outer layer of the same solder. The layers of solder on the additional conductive member and on the first electrode can also serve to improve the current-carrying capacity of (or even to create) the cross-conductor, by flowing into the aperture during the connection process.

SUMMARY OF THE INVENTION

We have found that during installation of these devices containing solder layers, particularly their installation on printed circuit boards, there is a danger that melting of the solder layers will not only make the desired connections, but will also create short circuits between the electrodes. These short circuits can be created by solder flowing across the gap between the additional conductive member and the second electrode, and/or by solder flowing between the electrodes. We have also found that if the outer surface of the first (upper) electrode is completely covered by a layer of solder which melts during installation of the device, this makes it impossible to provide the device with permanent markings which will identify the device after installation We have found, in accordance with the pre sent invention, that the problems caused by solder flow during installation can be mitigated or solved by the use of masking and/or separating materials which are applied to the device to provide permanent or temporary members which (a) ensure that solder layers to be used in the connection process are formed only in desired locations and/or (b) during installation of the device, prevent (or at least hinder) solder flow which results in short circuits between the electrodes, and/or (c) provide a convenient, permanent location for identification marks on the device. As discussed in detail below, the masking or separating material is preferably applied to an assembly which is later separated into a plurality of individual devices.

In a first aspect, the present invention provides an electrical device which has a reduced tendency to suffer from short circuits caused by solder flow during installation and which comprises (1) a laminar PTC resistive element which has a first face and second face;

(2) a first laminar electrode which has (i) an inner face which contacts the first face of the PTC element and (ii) an outer face;

(3) a second laminar electrode which has (i) an inner face which contacts the second face of the PTC element and (ii) an outer face;

(4) an additional laminar conductive member which
- (a) has (i) an inner face which contacts the second face of the PTC element and (ii) an outer face, and
- (b) is spaced apart from the second electrode;

the PTC element, the first electrode and the additional conductive member defining an aperture which runs between the first electrode and the additional conductive member, through the PTC element;

(5) a transverse conductive member which
- (a) is composed of metal,
- (b) lies within the aperture, and
- (c) is physically and electrically connected to the first electrode and the additional conductive member;

(6) a first layer of solder which is secured to the outer face of the additional conductive member;

(7) a second layer of solder which is secured to the outer face of the second electrode; and (8) a separation member which
- (a) is composed of a solid, non-conductive material,
- (b) lies between the first and second layers of solder, and
- (c) remains solid at temperatures at which the layers of solder are molten.

The separation member prevents the first and second layers of solder from flowing to create a short circuit between the electrodes when the layers of solder are heated to temperatures at which they are molten during installation of the device, e.g. on a printed circuit board.

In a second aspect, the present invention provides an electrical device which overcomes the problem that permanent markings cannot be made on a device whose entire upper surface is covered by a layer of a solder which melts when the device is installed. The devices of the second aspect of the invention comprise (1) a laminar PTC resistive element which has a first face and second face;

(2) a first laminar electrode which has (i) an inner face which contacts the first face of the PTC element and an outer face;

(3) a second laminar electrode which has (i) an inner face which contacts the second face of the PTC element and (ii) an outer face;

(4) an additional laminar conductive member which
 (a) has (i) an inner face which contacts the second face of the PTC element and (ii) an outer face, and
 (b) is spaced apart from the second electrode;

the PTC element, the first electrode and the additional conductive member defining an aperture which runs between the first electrode and the additional conductive member, through the PTC element;

(5) a transverse conductive member which
 (a) is composed of metal,
 (b) lies within the aperture, and
 (c) is physically and electrically connected to the first electrode and the additional conductive member;

(6) a first layer of solder which is secured to the outer face of the additional conductive member;

(7) a second layer of solder which is secured to the outer face of the second electrode;

(8) a third layer of solder which is secured to the outer face of the first electrode around the transverse conductive member; and (9) a masking member which
 (a) is composed of a solid material, and
 (b) is secured to the outer face of the first electrode adjacent to the third layer of solder.

In one embodiment of the second aspect of the invention, the masking member can be one which remains in place after the device has been installed and which (a) extends so that the second and third layers of solder do not overlap (when viewing the device at right angles to its principal plane), and/or (b) carries identification marks.

The masking member can be composed of a non-conductive material or a conductive material, e.g. a solder having a melting point substantially higher than the solder in the first, second and third layers of solder.

In another embodiment of the second aspect of the invention, the masking member is stripped off the first electrode before the device is installed. In this case also, the masking member can extend so that the second and third layers of solder do not overlap. After the masking member has been stripped off, identification marks can, if desired, be placed on the exposed surface of the first electrode, or on a metallic layer plated thereon.

The devices of the first aspect of the invention preferably include a third layer of solder which is secured to the outer face of the first electrode around the transverse conductive member. The third layer can extend over the whole of the outer face of the first electrode, but in order to reduce the danger of short circuits caused by molten solder dripping over the edge of the device, the third layer preferably extends over part only of the first electrode, especially so that the third layer of solder does not overlap the second layer of solder (when viewing the device at right angles to its principal plane). In order to confine the third layer of solder to preferred areas of the first electrode, the masking member preferably (a) is secured to the outer face of the first electrode before the third layer of solder is applied thereto and (b) remains solid at temperatures at which the first, second and third layers of solder are molten. The masking member can be composed of an electrically insulating material, e.g. a crosslinked organic polymer, or a conductive material, e.g. a solder having a higher melting point than the first, second and third layers of solder. The masking member can also carry identification marks, e.g. screen-printed onto an organic polymer masking member or laser-marked onto a high-melting solder masking member.

The invention also includes processes in which devices according to the first or second aspect of the invention are installed on a printed circuit board or other electrical substrate comprising spaced-apart electrical conductors. The conductors on the substrate preferably become connected to the additional conductive member and the second electrode respectively by soldered connections formed by reflowing the first and second layers of solder.

The invention also includes printed circuit boards and other electrical substrates comprising spaced-apart electrical conductors which are connected to a device according to the first or second aspect of the invention, the conductors being connected to the additional conductive member and the second electrode respectively by soldered connections.

As indicated above, the devices of this invention are preferably prepared by a process in which an assembly corresponding to a large number of devices is prepared, by successive treatments of a laminate of a PTC resistive member and upper and lower conductive members, thus simultaneously creating the various components of all the devices; and thereafter dividing the assembly into the individual devices. Depending upon the facilities available at different locations, the demands of manufacture, transportation and storage, and other factors, the assembly may be transported, sold or stored at different stages in its transformation into individual devices. Accordingly, these novel assemblies form part of the present invention. The treatment steps include removal of strips of at least one of the conductive members so as to provide, in the final devices, the spaced-apart additional conductive member and second electrode. Such removal is preferably accomplished by removal of strips from both conductive members, in order to ensure that the assembly retains balanced physical properties.

A preferred assembly of the invention comprises (1) a laminar PTC resistive member which has a first face and second face;

(2) a plurality of upper laminar conductive members, said upper members being in the form of spaced-apart strips which are parallel to each other, adjacent pairs of said upper members defining, with intermediate portions of the resistive element, a plurality of upper parallel channels, and each of said upper members having (i) an inner face which contacts the first face of the PTC member and (ii) an outer face;

(3) a plurality of lower laminar conductive members, said lower members being in the form of spaced-apart strips which are parallel to each other and to the upper members, adjacent pairs of said lower members defining, with intermediate portions of the resistive element, a plurality of lower parallel channels, and each of said lower members having (i) an inner face which contacts the first face of the PTC member and (ii) an outer face;

the PTC member and the laminar conductive members defining a plurality of spaced-apart apertures each of which runs between at least one of the upper conductive members and at least one of the lower conductive members, through the PTC member;

(4) a plurality of spaced-apart transverse conductive members each of which
  (a) is composed of metal,
  (b) lies within one of said apertures, and
  (c) is physically and electrically connected to at least one of the upper conductive members and at least one of the lower conductive members;

(5) a plurality of spaced-apart non-conductive separation members, the separation members being in the form of spaced-apart strips which are parallel to each other and to the upper and lower members, each of the separation members filling one of said upper or lower parallel channels and extending over part of the outer faces of the members defining the channel; and (6) a plurality of spaced-apart non-conductive masking members, the masking members being in the form of spaced-apart strips which (i) are parallel to each other and to the upper and lower members and (ii) alternate with, and are spaced apart from, the separation members, so that adjacent separation and masking members, with intervening portions of the resistive element, define a plurality of contact areas each of which includes at least one of said apertures.

In this preferred assembly, the cross-conductors are preferably formed by plating layers of metal onto the interior surfaces of the apertures. The plating on the apertures is preferably carried out on the assembly before removing strips from the upper and lower conductive members in order to create the upper and lower channels. This creates layers of plating on at least some, and preferably all, of the outer surfaces of the upper and lower members. After the upper and lower channels have been created, e.g. by etching strips from the (optionally plated) upper and lower conductive members, the separation members are formed (e.g. by photopolymerization of selected areas of a photo-resist, followed by removal of non-polymerized material), and solder is then applied, e.g. plated, onto the contact areas between the separation members.

BRIEF DESCRIPTION OF THE DRAWING

The invention is illustrated in the accompanying drawings, in which.

DETAILED DESCRIPTION OF THE INVENTION

Figure 1:
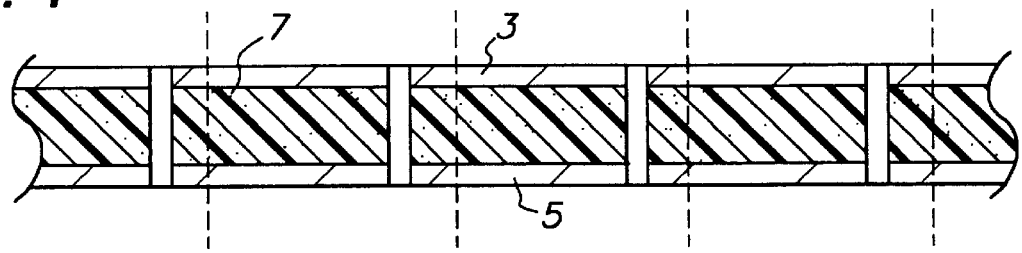
FIGS. 1–5 are diagrammatic partial cross-sections through an assembly as it is converted from a simple laminate of a PTC conductive polymer member sandwiched between two metal foils into an assembly which is ready for division into a plurality of devices of the invention.

The invention is described below chiefly by reference to PTC circuit protection devices which comprise a laminar PTC element composed of a PTC conductive polymer and two laminar electrodes secured directly to the PTC element, and to the production of such devices. It is to be understood, however, that the description is also applicable, insofar as the context permits, to other electrical devices containing PTC conductive polymer elements, to electrical devices containing PTC ceramic elements, and to other electrical devices comprising two laminar electrodes with a laminar electrical element between theme.

As described and claimed below, and as illustrated in the accompanying drawings, and as further described and illustrated in the documents incorporated herein by reference, the present invention can make use of a number of particular features. Where such a feature is disclosed in a particular context or as part of a particular combination, it can also be used in other contexts and in other combinations, including for example other combinations of two or more such features.

Materials which are suitable for use as separation members and masking members include polyesters and a wide variety of other polymers, optionally mixed with other ingredients. Such materials, are well known, as also are methods of using them to produce members of desired thickness and shape, e.g. by photo-resist and photo-imaging techniques.

For additional details of the PTC compositions, laminar electrodes, apertures and cross-conductors, assemblies and processes which can be used in the present invention, and of the dimensions, resistance and installation of the devices of this invention, reference should be made to U.S. application Ser. No. 08/121,717 incorporated by reference herein, bearing in mind any modifications that may be necessary in order to make use of masking and/or separating materials in accordance with this invention.

Thus the apertures in the devices of the present invention are preferably openings which, when viewed at right angles to the plane of the device, (a) have a closed cross section, e.g. a circle, an oval, or a generally rectangular shape, or (b) have a reentrant cross section, a reentrant cross section being defined as an open cross section which (i) has a depth of at least 0.15 times, preferably at least 0.5 times, particularly at least 1.2 times, the maximum width of the cross section, e.g. a quarter circle or a half circle or an open-ended slot, and/or (ii) has at least one part where the opposite edges of the cross section are parallel to each other.

In assemblies of the invention which can be divided into a plurality of electrical devices, the apertures will normally be of closed cross section, but if one or more of the lines of division passes through an aperture of closed cross section, then the apertures in the resulting devices will then have open cross sections. It is preferred that any such open cross section is a reentrant cross section as defined above, in order to ensure that the cross-conductor is not damaged or dislodged during installation or use of the device.

The aperture can be a circular hole, and for many purposes this is satisfactory in both individual devices and assemblies of devices. However, if the assembly includes apertures which are traversed by at least one line of division, elongate apertures may be preferred because they require less accuracy in the lines of division.

When the aperture is not traversed by a line of division, it can be as small as is convenient for a cross-conductor having the necessary current-carrying capacity. For circuit protection devices, holes of diameter 0.1 to 5 mm, preferably 0.15 to 1.0 mm, e.g. 0.2 to 0.5 mm, are generally satisfactory. Generally a single cross-conductor is all that is needed to make an electrical connection to the first electrode from the opposite side of the device. However, two or more cross-conductors can be used to make the same connection. The number and size of the cross-conductors, and, therefore, their thermal capacity, can have an appreciable influence on the rate at which a circuit protection device will trip.

Figure 2:
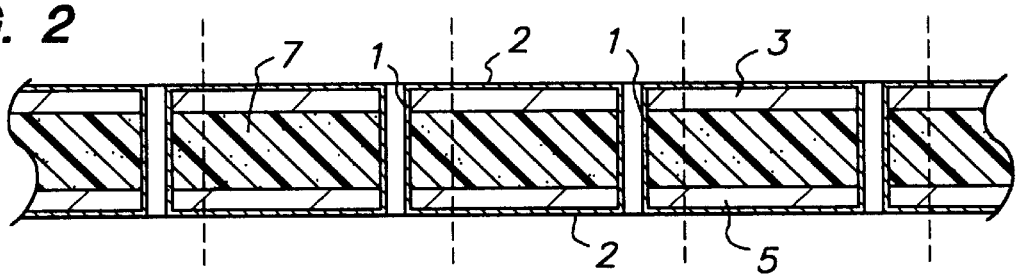
Figure 3:
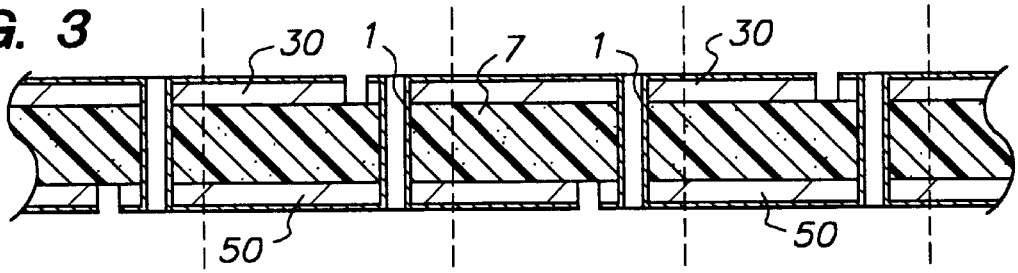
Figure 7:
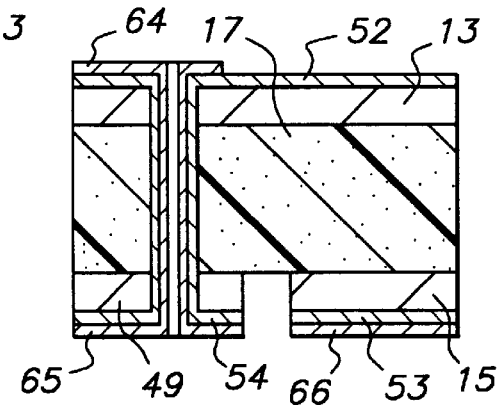

The invention is illustrated in the accompanying drawings, in which the size of the apertures and the thicknesses of the components have been exaggerated in the interests of clarity. FIGS. 1 to 5 are diagrammatic partial cross-sections through a laminated plaque as it is converted into an assembly which can be divided into a plurality of individual devices of the invention by shearing it along the broken lines and along lines at right angles thereto (not shown in the Figures). A diagrammatic partial plan view of the assembly of FIG. 3 is shown in FIG. 7 of U.S. application Ser. No. 08/121,717 incorporated by reference herein.

Figure 4:
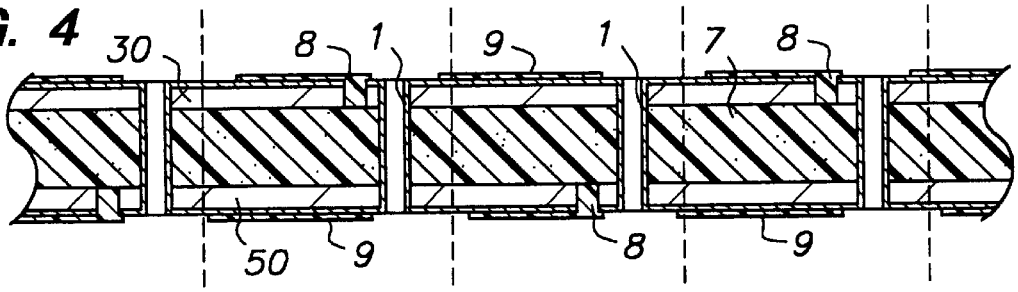
Figure 5:
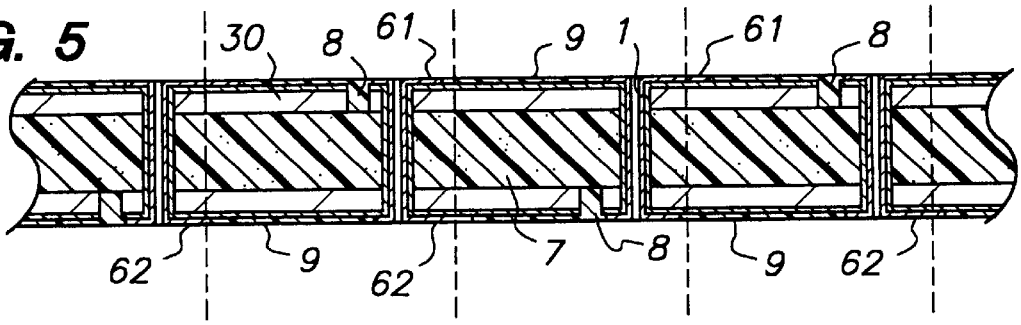

FIG. 1 shows an assembly containing a laminar PTC element 7 composed of a PTC conductive polymer and having a first face to which metal foil 3 is attached and a second face to which metal foil 5 is attached. A plurality of round apertures, arranged in a regular pattern, have been drilled through the assembly. FIG. 2 shows the assembly of FIG. 1 after electroplating it with a metal which forms cross-conductors 1 on the surfaces of the apertures and metal layers 2 on the outer faces of the foils 3 and 5. FIG. 3 shows the assembly of FIG. 2 after etching the plated foils 3 and 5 so as to divide them into a plurality of upper members 30 and a plurality of lower members 50, with adjacent pairs of such members defining, with intermediate portions of the PTC element 7, a plurality of upper and lower parallel channels. FIG. 4 shows the assembly of FIG. 3 after the formation, by a photo-resist process, of (a) a plurality of parallel separation members 8 which fill the upper and lower channels and extend over part of the outer faces of the adjacent members 30 or 50, and (b) a plurality of parallel masking members 9 placed so that adjacent separation and masking members define, with the PTC element 7, a plurality of contact areas. FIG. 5 shows the assembly of FIG. 4 after electroplating it with a solder so as to form layers of solder 61 and 62 on the contact areas and also layers of solder on the cross-conductors. It will be seen that the contact areas are arranged so that when an individual device is prepared by dividing up the assembly, the solder layers overlap only in the vicinity of the cross-conductor, so that if any solder flows from top to bottom of the device, while the device is being installed, it will not contact the layer of solder on the second electrode.

FIGS. 6–10 are diagrammatic cross-sections through devices of the invention having a rectangular or square shape when viewed in plan. In each of FIGS. 6–10, the device includes a laminar PPC element 17 having a first face to which first metal foil electrode 13 is attached and a second face to which second metal foil electrode 15 is attached. Also attached to the second face of the PTC element is an additional metal foil conductive member 49 which is not electrically connected to electrode 15. Cross-conductor 51 lies within an aperture defined by first electrode 13, PTC element 17 and additional member 49. The cross-conductor is a hollow tube formed by a plating process which also results in platings 52, 53 and 54 on the surfaces of the electrode 13, the electrode 15 and the additional member 49 respectively which were exposed during the plating process. In addition, layers of solder 64, 65, 66 and 67 are present on (a) the first electrode 13 in the region of the cross-conductor 51, (b) the additional member 49, (c) the second electrode 15, and (d) the cross-conductor 51, respectively.

Figure 6:
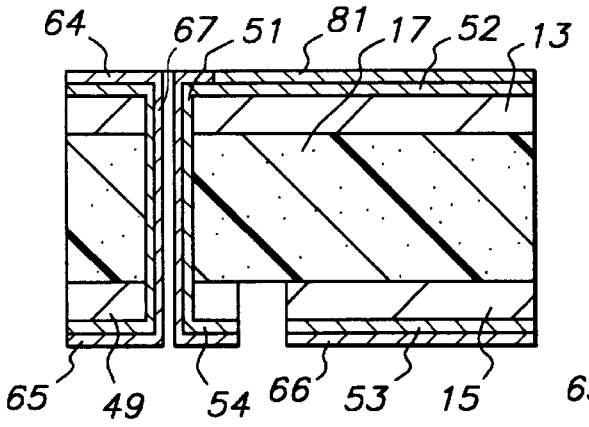
FIGS. 6–10 are diagrammatic cross-sections through devices of the invention.

FIG. 6 also shows a masking member 81 composed of a solder having a melting point substantially higher than the solder of layers 64, 65, 66 and 67. The masking member 81 is put in place before the layers 64, 65, 66 and 67 and thus masks the electrode 13 so that the solder layer 64 does not overlap the solder layer 66. The member 81 can also serve as a site for permanent marking of the device. The member 81 can alternatively be composed of an electrically insulating material which does not flow when the device is installed.

FIG. 7 is a product obtained from a device as shown in FIG. 6 by removing the masking member 81, thus exposing part of the plated first electrode 13 which can be used as a site for permanent marking of the device.

Figure 8:
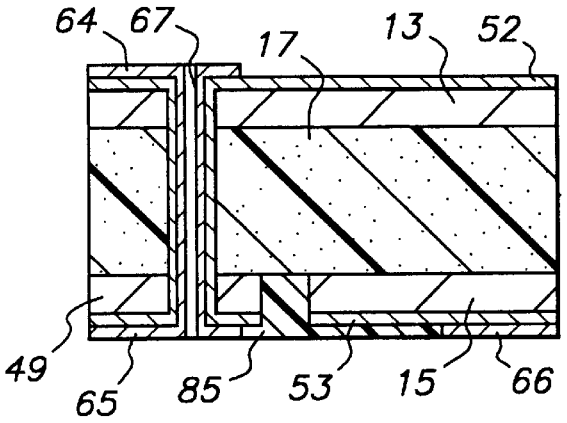

FIG. 8 is similar to FIG. 7 but also includes a separation member 85 which (a) is composed of an electrically insulating material 85, (b) fills the channel between second electrode 15 and additional member 49, and (c) extends over part of electrode 15 and member 49, so that the solder layers 65 and 66 are less extensive.

Figure 9:
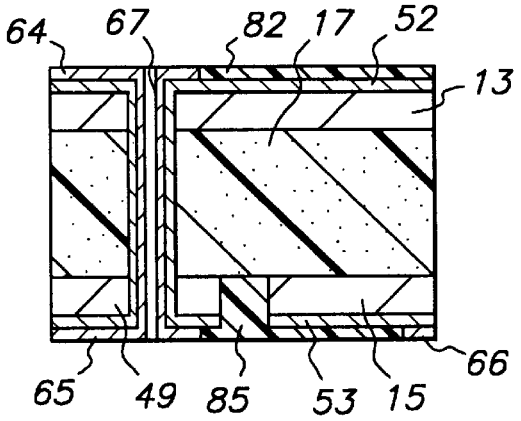

FIG. 9 is the same as FIG. 8 except that it also contains masking member 82 which is composed of an electrically insulating material.

Figure 10:
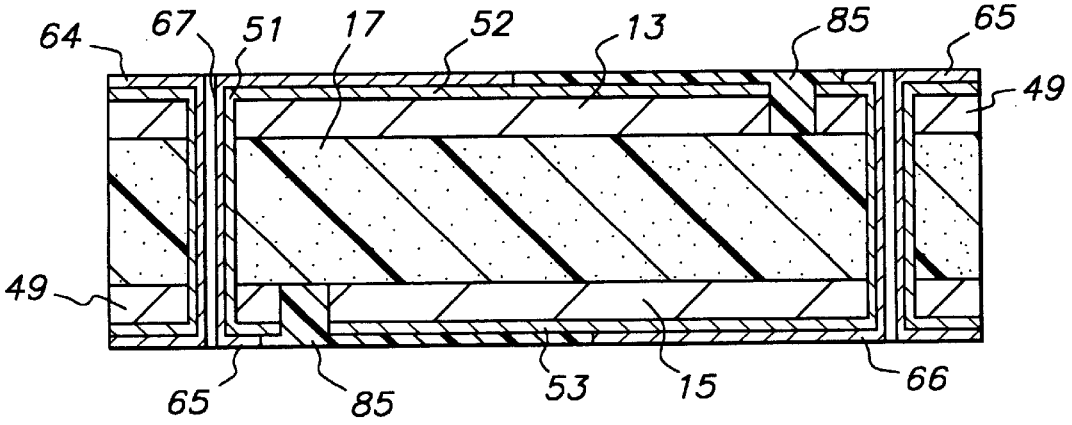

FIG. 10 is similar to FIG. 9 but is a symmetrical device which can be connected in the same way from either side of the device.

Figure 11:
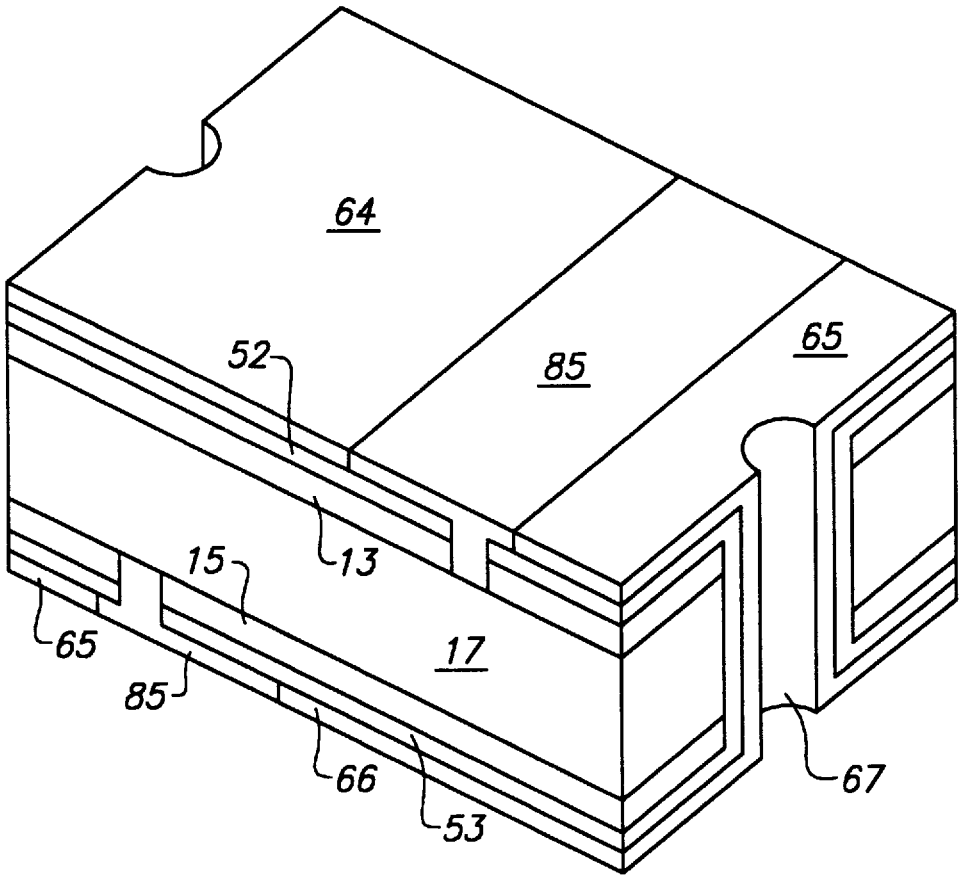
FIG. 11 is a diagrammatic perspective view of a device of the invention.

FIG. 11 is a perspective view of a device similar to the device shown in FIG. 10, except that the cross conductors lie within apertures which were formed by division along lines passing through cylindrical plated apertures and which have, therefore, a cross section which is a half-circle.

EXAMPLE

A plaque containing a laminar PTC conductive polymer element sandwiched between two nickel foils was prepared as described in the Example of Ser. No. 08/121,717 referred to above. The plaque was converted into a large number of devices by the following process.

Holes of diameter 0.25 mm (0.01 inch) were drilled through the plaque in a regular pattern which provided one hole for each device. The holes were cleaned, and the plaque was then treated so that the exposed surfaces of the foils and of the holes were given an electroless copper plating and then an electrolytic copper plating about 0.076 mm (0.003 inch) thick.

After cleaning the plated plaque, photo resists were used to produce masks over the plated foils except along parallel strips corresponding to the gaps between the additional conductive members and the second electrodes in the devices. The exposed strips were etched to remove the plated foils in those areas, and the masks removed.

After cleaning the etched, plated plaque, a masking material was screen-printed and tack-cured on one side of the plaque and then screen-printed and tack-cured on the other side of the plaque. The screen-printed masking material was in approximately the desired final pattern, but somewhat oversize. The final pattern was produced by photo-curing precisely tie desired parts of the masking material through a mask, followed by washing to remove the masking material which had not been fully cured. On each side of the plaque, the fully cured material masked (a) the areas corresponding to the first electrode in each device, except for a strip containing the cross-conductor, (b) the etched strips, (c) the areas corresponding to the second electrode, except for a strip at the end remote from the cross-conductor, and (d) the areas corresponding to the additional conductive member except for a strip adjacent to the cross-conductor.

The masking material was then marked (e.g. with an electrical rating and/or a lot number) by screen-printing an ink, followed by curing the ink, in the areas corresponding to the first electrode (which provides the top surface of the installed device).

The areas of the plaque not covered by masking material were then electrolytically plated with tin/lead (63/37) solder to a thickness of about 0.025 mm (0.001 inch).

Finally, the plaque was sheared and diced to divide it up into individual devices.

We claim:

1. An electrical device which comprises (1) a laminar PTC resistive element which has a first face and second face;

(2) a first laminar electrode which has (i) an inner face which contacts the first face of the PTC resistive element and (ii) an outer face;

(3) a second laminar electrode which has (i) an inner face which contacts the second face of the PTC resistive element and (ii) an outer face;

(4) an additional laminar conductive member which (a) has (i) an inner face which contacts the second face of the PTC resistive element and (ii) an outer face, and (b) is spaced apart from the second laminar electrode;

the PTC resistive element, the first laminar electrode and the additional laminar conductive member defining an aperture which runs between the first laminar electrode and the additional laminar conductive member, through the PTC resistive element;

(5) a transverse conductive member which (a) is composed of metal, (b) lies within the aperture, and (c) is physically and electrically connected to the first laminar electrode and the additional laminar conductive member;

(6) a first layer of solder which is secured to the outer face of the additional laminar conductive member;

(7) a second layer of solder which is secured to the outer face of the second laminar electrode; and (8) a separation member which (a) is composed of a solid, non-conductive material, (b) lies between the first and second layers of solder, and (c) remains solid at temperatures at which the first and second layers of solder are molten.

2. A device according to claim 1 which is rectangular in shape, wherein the aperture has a closed cross section, and wherein the separation member is in the form of a bar which crosses the full width of the device.

3. A device according to claim 1 wherein the PTC resistive element is composed of a conductive polymer and the first and second laminar electrodes and the additional laminar conductive member are metal foils.

4. A device according to claim 1 which comprises a third layer of solder which is secured to the outer face of the first laminar electrode around the transverse conductive member.

5. A device according to claim 4 which comprises a masking member which (a) is composed of a solid material, and (b) is secured to the outer face of the first laminar electrode adjacent to the third layer of solder.

6. A device according to claim 5 wherein the masking member (a) remains solid at temperatures at which the first, second and third layers of solder are molten, and (b) carries identification marks.

7. A device according to claim 4 wherein the third layer of solder does not overlap the second layer of solder.

8. A device according to claim 1 wherein the transverse conductive member comprises a metal layer which is plated onto the aperture and wherein there are layers of the same metal plated onto the outer faces of the first and second laminar electrodes.

9. A device according to claim 1 wherein the aperture has an open cross section.

10. A device according to claim 1 wherein the cross section of the aperture is a half-circle.

11. An assembly which comprises (1) a laminar PTC resistive member which has a first face and second face;

(2) a plurality of upper laminar conductive members, said upper laminar conductive members being in the form of spaced-apart strips which are parallel to each other, adjacent pairs of said upper laminar conductive members defining, with intermediate portions of the PTC resistive member, a plurality of upper parallel channels, and each of said upper laminar conductive members having (i) an inner face which contacts the first face of the PTC resistive member and (ii) an outer face;

(3) a plurality of lower laminar conductive members, said lower laminar conductive members being in the form of spaced-apart strips which are parallel to each other and to the upper laminar conductive members, adjacent pairs of said lower laminar conductive members defining, with intermediate portions of the PTC resistive member, a plurality of lower parallel channels, and each of said lower laminar conductive members having (i) an inner face which contacts the first face of the PTC resistive member and (ii) an outer face;

the PTC resistive member and the upper and lower laminar conductive members defining a plurality of spaced-apart apertures each of which runs between at least one of the upper laminar conductive members and at least one of the lower laminar conductive members, through the PTC resistive member;

(4) a plurality of spaced-apart transverse conductive members each of which (a) is composed of metal, (b) lies within one of said apertures, and (c) is physically and electrically connected to at least one of the upper laminar conductive members and at least one of the lower laminar conductive members;

(5) a plurality of spaced-apart non-conductive separation members, the separation members being in the form of spaced-apart strips which are parallel to each other and to the upper and lower laminar conductive members, each of the separation members filling one of said upper and lower parallel channels and extending over part of the outer faces of the upper and lower laminar conductive members defining the upper and lower parallel channels; and (6) a plurality of spaced-apart non-conductive masking members, the masking members being in the form of spaced-apart strips which (i) are parallel to each other and to the upper and lower laminar conductive members and (ii) alternate with, and are spaced apart from, the separation members, so that adjacent separation and masking members, with intervening portions of the PTC resistive member, define a plurality of contact areas each of which includes at least one of said apertures.

12. An assembly according to claim 11 wherein each of the transverse conductive members comprises a metal layer which is plated onto one of the apertures, and wherein there are layers of the same metal plated onto the outer faces of the upper and lower laminar conductive members.

13. A assembly according to claim 11 which comprises layers of solder which cover said contact areas.

* * * * *

UNITED STATES PATENT AND TRADEMARK OFFICE

CERTIFICATE OF CORRECTION

PATENT NO. : 5,831,510

INVENTOR(S) : Zhang et al.

DATED : November 3, 1998

It is certified that error appears in the above-identified patent and that said Letters Patent is hereby corrected as shown below:

TITLE PAGE:

References Cited [56], Other Publications, line 9, after "Raychem Corporation, Nov. 1992", insert, as a new line --Printed Circuit Handbook, (Coombs, 1996), Pages 24.1-24.17--.

Column 2, line 8, replace "pre sent" by --present--.

Column 3, line 6, before "an" insert --(ii)--.

Column 8, line 53, replace "tie" by --the--.

Signed and Sealed this

Eighteenth Day of April, 2000

*Attest:*

Q. TODD DICKINSON

*Attesting Officer*

*Director of Patents and Trademarks*